US008436743B2

(12) United States Patent
Auzerais et al.

(10) Patent No.: US 8,436,743 B2
(45) Date of Patent: May 7, 2013

(54) METHOD AND APPARATUS FOR MEASURING A PARAMETER WITHIN THE WELL WITH A PLUG

(75) Inventors: François Auzerais, Houston, TX (US); Iain Cooper, Sugar Land, TX (US); Dominique Guillot, Somerville, MA (US); Dominic McCann, Romsey Hampshire (GB); Pierre Vigneaux, Moisenay (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 1514 days.

(21) Appl. No.: 11/744,289

(22) Filed: May 4, 2007

(65) Prior Publication Data

US 2008/0272931 A1 Nov. 6, 2008

(51) Int. Cl.
*E21B 49/00* (2006.01)

(52) U.S. Cl.
USPC ..... 340/854.7; 166/66

(58) Field of Classification Search ..... 340/854.7; 166/66
See application file for complete search history.

(56) References Cited

U.S. PATENT DOCUMENTS

| | | | | |
|---|---|---|---|---|
| 252,956 | A | 1/1882 | Loane | |
| 3,547,406 | A | 12/1970 | Bielstein | |
| 6,281,489 | B1 | 8/2001 | Tubel | |
| 6,302,203 | B1 | 10/2001 | Rayssiguier et al. | |
| 6,531,694 | B2 | 3/2003 | Tubel | |
| 6,634,425 | B2 | 10/2003 | King | |
| 6,787,758 | B2 | 9/2004 | Tubel | |
| 6,847,034 | B2 * | 1/2005 | Shah et al. | 250/269.1 |
| 6,978,832 | B2 * | 12/2005 | Gardner et al. | 166/250.1 |
| 7,004,638 | B2 | 2/2006 | Nicholson | |
| 7,040,390 | B2 | 5/2006 | Tubel | |
| 7,201,221 | B2 | 4/2007 | Tubel | |
| 2002/0157828 | A1 | 10/2002 | King et al. | |
| 2004/0045705 | A1 | 3/2004 | Gardner et al. | |
| 2004/0047534 | A1 | 3/2004 | Shah et al. | |

FOREIGN PATENT DOCUMENTS

| | | |
|---|---|---|
| EP | 1854959 | 7/2008 |
| GB | 2119949 | 11/1983 |
| GB | 2119949 A | 11/1983 |
| GB | 2349440 | 11/2000 |
| GB | 2349440 A | 11/2000 |

(Continued)

OTHER PUBLICATIONS

Well Cementing, Erik B. Nelson and Guillot D., Schlumberger Educational Services, 2006.

*Primary Examiner* — John Kreck
(74) *Attorney, Agent, or Firm* — Michael Dae

(57) ABSTRACT

A system for measuring a parameter within a well comprises a first and second apparatus. The first apparatus comprises a first reel of first wound optic fiber line (or fiber) able to be unwound from the first reel and at least a first sensor able to measure the parameter of the well, wherein information on the parameter can be transmitted through the first optic fiber. The second apparatus comprises a second reel of second wound optic fiber line able to be unwound from the second reel, an extremity of the second optic fiber being fixed to a reference point. A light transmitter or receiver device is linked to the reference point and able to generate or detect a light pulse through the second optic fiber line. Means to exchange the light pulse between first and second optic fiber line are also provided.

26 Claims, 6 Drawing Sheets

FOREIGN PATENT DOCUMENTS

| | | | |
|---|---|---|---|
| GB | 2393465 | | 3/2004 |
| GB | 2393465 | A | 3/2004 |
| WO | 02059458 | | 8/2002 |
| WO | WO02059458 | A2 | 8/2002 |
| WO | 02082151 | | 10/2002 |
| WO | WO02082151 | A1 | 10/2002 |

* cited by examiner

METHOD AND APPARATUS FOR MEASURING A PARAMETER WITHIN THE WELL WITH A PLUG

FIELD OF THE INVENTION

The present invention generally relates to apparatus and methods for completing a well. Particularly, the present invention relates to apparatus and methods for measuring a parameter of the well with a cementing apparatus in the wellbore, as a cement plug. More particularly, the present invention relates to apparatus and methods for communicating along the whole annulus from cement plug to surface.

DESCRIPTION OF THE PRIOR ART

After a well has been drilled, the conventional practice in the oil industry consists in lining the well with a metal casing. An annular area is thus formed between the casing and the formation. A cementing operation is then conducted in order to fill the annular area with cement. The combination of cement and casing strengthens the wellbore and facilitates the isolation of certain areas of the formation behind the casing for the production of hydrocarbons. It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or a liner, is run into the well. The second string is set at a depth such that the upper portion of the second string of casing overlaps the lower portion of the first string of casing. The second liner string is then fixed or hung off of the existing casing. Afterwards, the second casing string is also cemented. This process is typically repeated with additional liner strings until the well has been drilled to total depth. In this manner, wells are typically formed with two or more strings of casing of an ever-decreasing diameter.

The process of cementing a liner into a wellbore typically involves the use of liner wiper plugs and drill-pipe darts. Plugs typically define an elongated elastomeric body used to separate fluids pumped into a wellbore. A liner wiper plug is typically located inside the top of a liner, and is lowered into the wellbore with the liner at the bottom of a working string. The liner wiper plug has radial wipers to contact and wipe the inside of the liner as the plug travels down the liner. The liner wiper plug has a cylindrical bore through it to allow passage of fluids.

Typically, the cementing operation requires the use of two plugs and darts. When the cement is ready to be dispensed, a first dart is released into the working string. The cement is pumped behind the dart, thereby moving the dart downhole. The dart acts as a barrier between the cement and the drilling fluid to minimize the contamination of the cement. As the dart travels downhole, it seats against a first liner wiper plug and closes off the internal bore through the first plug. Hydraulic pressure from the cement above the dart forces the dart and the plug to dislodge from the liner and to be pumped down the liner together. At the bottom, the first plug seats against a float valve, thereby closing off fluid flow through the float valve. The pressure builds above the first plug until it is sufficient to cause a membrane in the first plug to rupture. Thereafter, cement flows through the first plug and the float valve and up into the annular space between the wellbore and the liner.

After a sufficient volume of cement has been placed into the wellbore, a second dart is deployed. Drilling mud is pumped in behind the second dart to move the second dart down the working string. The second dart travels downhole and seats against a second liner wiper plug. Hydraulic pressure above the second dart forces the second dart and the second plug to dislodge from the liner and they are pumped down the liner together. This forces the cement ahead of the second plug to displace out of the liner and into the annulus. This displacement of the cement into the annulus continues until the second plug seats against the float valve. Thereafter, the cement is allowed to cure before the float valve is removed.

The cementing operation can also require the use of a single plug and dart: the first plug or dart of the preceding operation being removed.

During the cementing operation, it would be valuable to be able to measure the downhole temperature and pressure at various points along the borehole as the plug is circulated, and also in the annulus as the cement sets. At the current time this can not be done as there is no robust telemetry method that is practical with conventional operating practices. Some prior arts have attempted to describe apparatus for measuring parameters from the cement plug.

U.S. Pat. No. 6,634,425 describes a cementing plug with a sensor transmitting the measured value to surface location via wire or wireless transmitting means, as for example: wire cable, fiber optic or acoustic waves. The problem is that the cementing plug can not be deployed for long distances and measurements are limited only to measured value on the plug, so inside the casing and at the exact position of the plug.

European patent application number 06290801.7 from the same applicants describes a way of deploying an optic fiber from surface down to the landing collar by attaching a fiber spool to the top plug, the top plug being pumped down the casing with the displacement fluid. Indeed the system is an improvement in the method of measuring parameter in the wellbore; the system is insufficient because when a sensor is used on the top plug or on the fiber, measurements are still limited to the inside the casing.

There is a need, therefore, for an easy apparatus for measuring a parameter inside the wellbore casing, as well as the wellbore annulus. In this way, there is a need for an apparatus for correctly and precisely determining parameters informing on the set of the cement.

SUMMARY OF THE INVENTION

According to one aspect of the invention, the invention provides a system for measuring a parameter within a well, made of: a first apparatus comprising a first reel of first wound optic fiber line (or fiber) able to be unwound from the first reel, at least a first sensor able to measure the parameter of the well, wherein information on said parameter can be transmitted trough the first optic fiber; a second apparatus comprising a second reel of second wound optic fiber line able to be unwound from the second reel, an extremity of the second optic fiber being fixed to a reference point; a light transmitter or receiver device linked to the reference point and able to generate or detect a light pulse through the second optic fiber line; and means to exchange said light pulse between first and second optic fiber line. The light transmitter or receiver is a transmitter/receiver not only limited to visible light, other electromagnetic radiations including ultraviolet radiations (near UV (380-200 nanometers wavelength); and/or far or vacuum UV (200-10 nanometers; FUV or VUV); and/or extreme UV (1-31 nanometers; EUV or XUV)) and infrared radiations (preferably: O-band 1260-1360 nanometers; and/or E-band 1360-1460 nanometers; and/or S-band 1460-1530 nanometers; and/or C-band 1530-1565 nanometers; and/or L-band 1565-1625 nanometers; and/or U-band 1625-1675 nanometers) are enclosed in the light transmitter/receiver. The both optic fibers also work in the same wavelength as the light transmitter or receiver. Preferably, both first and second fibers are the same.

Preferably, the sensor is a miniaturized sensor self supplied in power. The associated electronics are small and with low consummation: a sensor with limited volume and limited power supply allow a minimum bulk. For example, sensors can be of the type MEMS. Most preferably, the sensor is auto-sufficient in terms of power supply. For example, sensors can be of the type optical sensor even embodied within the optic fiber line; when an optical signal is sent to the optical sensor, the signal reflected by said sensor informed on the measured physical parameter. For example, the sensor is a temperature sensor and/or a pressure sensor in the family of Bragg grating sensor. More preferably, the system comprises several sensors distributed on the first optic fiber line, advantageously of the type Bragg grating sensors. The major advantage is that there is no need of complex or unwieldy electronic or power supply to support the sensor. All the electronic and analyzing part is at the reference point, a signal is sent from the reference point to the embedded sensor, the reflected signal received at the reference point is analyzed and informs on the measured physical parameter in the vicinity of the sensor. Sensor can measure: temperature, pressure, pH, density, resistivity, conductivity, salinity, carbon dioxide concentration, asphaltene concentration. The reference point is preferably at surface.

The system of the invention applies to apparatus as a dart or a plug, but other embodiments can be achieved. The reels have a diameter between 20 and 50 millimeters, and preferably between 30 and 35 millimeters for a light pulse wavelength of 1310 or 1550 nanometers.

According to another aspect of the invention, the invention provides a system for measuring a parameter within a well, made of: a first apparatus comprising a first reel of first optic fiber line, wherein a first part of the first optic fiber line is wound and a second part of the first optic fiber line is unwound in an annulus, at least a first sensor located on said second part and able to measure the parameter of said annulus, wherein information on said parameter can be transmitted trough the first optic fiber; a second apparatus comprising a second reel of second wound optic fiber line able to be unwound from the second reel, an extremity of the second optic fiber being fixed to a reference point; a light transmitter and receiver device linked to the reference point and able to generate and detect a light pulse through the second optic fiber line; and exchange device to transfer said light pulse between first and second optic fiber line or second and first optic fiber line.

Preferably, the first apparatus is deployed in a liner as for example a casing shoe. The first reel is then in a collar launching. Also first and/or second apparatus can be deployed in a plug or dart.

According still to another aspect of the invention, the invention provides a system for measuring a parameter within a well, the well comprising an annulus, the system being made of: an apparatus comprising a first reel of first optic fiber line, wherein a first part of the first optic fiber line is wound and a second part of the first optic fiber line is unwound in the annulus, at least a first sensor located on said second part and able to measure the parameter of said annulus, wherein information on said parameter can be transmitted trough the first optic fiber; a light transmitter and receiver device linked to said first optic fiber and able to generate and detect a light pulse through the first optic fiber line; and communication device to transfer said light pulse between first optic fiber line and surface.

Preferably, the annulus is between formation and casing, however annulus between two liners can also be used. More preferably, the communication device is made of second apparatus as disclosed above.

The invention provides also a method for measuring a parameter within a well, comprising the step of: (i) unwinding a first reel of first wound optic fiber line positioned on a first apparatus; (ii) unwinding from a reference point a second reel of second wound optic fiber line positioned on a second apparatus; (iii) transmitting or receiving from the reference point a light pulse through the second optic fiber line; (iv) exchanging said light pulse between first and second optic fiber lines; and (v) sensing with said light pulse the parameter and transmitting it on the first optic fiber line.

Said method is used with systems as disclosed above. Preferably, the exchanging step is made also by bringing closer first and second apparatus. In a first embodiment, the exchanging step is made by interconnecting first and second optic fiber lines. And in a second embodiment, the exchanging step is made by transforming the light pulse from one optic fiber line into an electromagnetic or acoustic signal, transferring said signal within the well and re-transforming said signal into the light pulse in the second optic fiber line.

The invention provides also in a further aspect, a method for communicating a parameter within a well, comprising the step of: (i) unwinding a first reel of first wound optic fiber line positioned on a first apparatus; (ii) unwinding from a reference point a second reel of second wound optic fiber line positioned on a second apparatus; (iii) transmitting or receiving from the reference point a light pulse through the second optic fiber line; (iv) exchanging said light pulse between first and second optic fiber lines; and (v) transmitting the light pulse through the first optic fiber line; and (vi) communicating in this way said parameter between the first and second optic fiber lines.

Said method is also used with systems as disclosed above. Preferably the exchanging step is made also by bringing closer first and second apparatus. In a first embodiment, the exchanging step is made by interconnecting first and second optic fiber lines. And in a second embodiment, the exchanging step is made by transforming the light pulse from one optic fiber line into an electromagnetic or acoustic signal, transferring said signal within the well and re-transforming said signal into the light pulse in the second optic fiber line.

The invention provides finally in a further aspect, a method for communicating a parameter within a well, the well comprising an annulus, the method comprising the step of: (i) unwinding in said annulus a first reel of first wound optic fiber line positioned on a first apparatus downhole; (ii) transmitting or receiving a light pulse through the first optic fiber line; (iii) communicating said light pulse between said first optic fiber line from first apparatus to surface. Preferably the method further comprises a step of sensing with said light pulse a parameter within the annulus and transmitting it on the first optic fiber line.

BRIEF DESCRIPTION OF THE DRAWINGS

Further embodiments of the present invention can be understood with the appended drawings.

DETAILED DESCRIPTION

Figure 1A:
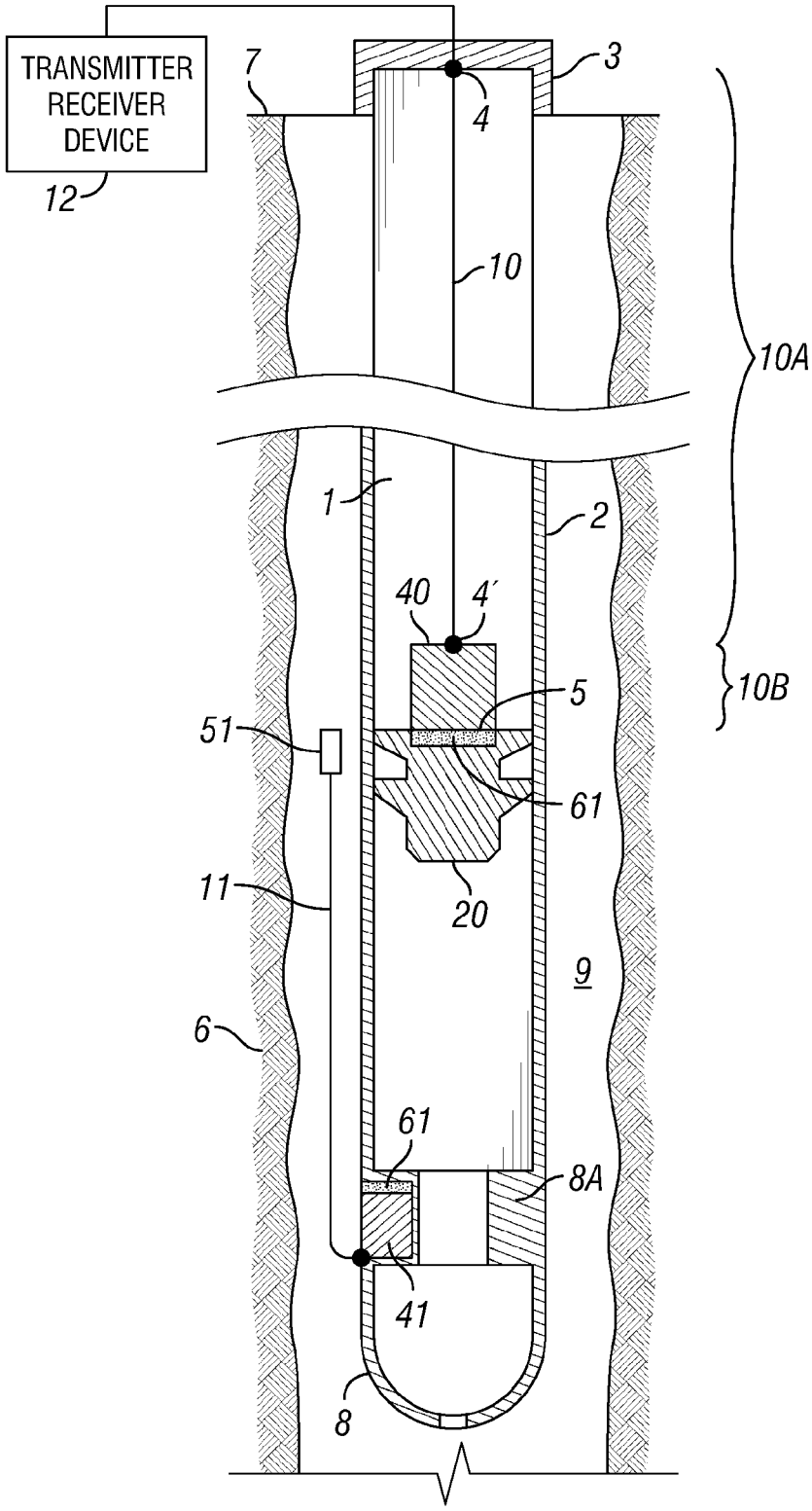
FIG. 1A shows a schematic diagram illustrating the system in a first embodiment according to the invention.

FIG. 1A is a view of the system in a first embodiment deployed in a cased wellbore 1 within a formation 6. The wellbore is made of a casing 2 with a guide shoe 8. The guide shoe 8 comprises a landing collar 8A with float valve. The casing forms an annulus 9 between the casing 2 and the formation 6. The system according to the invention is made of a first apparatus embodied here as the guide shoe 8, which comprises a first reel 41 of a first wound optic fiber line 11. The first reel 41 is located here within the landing collar 8A. Further, the first optic fiber line 11 is able to be unwound from the first reel 41. The first optic fiber 11 unwinds directly in the annulus 9 as shown on FIG. 1A. However by way of others embodiments, the first reel 41 can be located elsewhere; the first optic fiber 11 can be deployed inside the casing 2 and can also go through the guide shoe 8 into the annulus 9. The first apparatus comprises also at least a first sensor 51 able to measure a parameter of the well. Advantageously, the parameter of the well is measured within the annulus 9. Such parameter can be by way of examples: the temperature, pressure, pH, density, resistivity, conductivity, salinity, $CO_2$ or asphaltene concentration or other parameters of the like informing on the cement setting, the well integrity, or the well productivity. The first sensor 51 is preferably located on the extremity of the first optic fiber 11 or on the first optic fiber that is unwound. The first optic fiber 11 is such that information on the parameter measured by the first sensor 51 can be transmitted through the first optic fiber, so the optic fiber line is linked to the sensor and is a communication means.

The system of the invention is also made of a second apparatus embodied in FIG. 1A in a plug 20. The plug 20 is shown moving along the casing 2 thanks to a wellbore fluid. A second optic fiber line 10 or fiber which is wound in a second reel 40 is attached to an upper portion of the plug; practically the second reel is attached or fixed through a unique point of hanging 5 which correspond to an end of the fiber or through a part of the second reel. The second reel can also be mounted in a housing or cartridge. The importance is that when the plug is able to move along the wellbore, the second reel and the plug are interdependent, but the fiber can be unwound from the second reel. On the other end of the second fiber, the fiber is attached or fixed to a first position 4, or a reference point. As it is understood, the second fiber is unwound from the second reel thanks only to the movement of the plug at a second position 4', which correspond to a dynamic point. An upper part 10A of the second fiber corresponds to the unwound fiber (between the first position and the second position) and a lower part 10B of the second fiber corresponds to the wound fiber, still in the second reel. Preferably, the first position 4 is located inside a cementing head 3, which is a static point on the surface 7. From this first position the second fiber is linked to a light transmitter or receiver device 12 via a feedthrough: the low-pressure side being connected to the device 12 and the high-pressure side being connected to the second optic fiber line 10. The light transmitter device is able to generate a light pulse through the second optic fiber line. The light receiver device is able to detect a light pulse through the second optic fiber line.

Finally, the system of the invention comprises a means 61 to exchange the light pulse between the first optic fiber line 11 and the second optic fiber line 10. Said means can be a direct interconnection means, as for example a wet mateable connector system, also an indirect exchange means of the type wire or wireless system can be used, the optic signal being transformed to an electric signal transferred through wire or elements of the well as casing, or to an acoustic signal or to an electromagnetic signal as radiofrequencies being transferred through wellbore fluids or elements of the well. The means 61 is therefore located near the first reel 41 and connected to the extremity of the first optic fiber line 11 and also located near the second reel 40 and connected to the extremity of the second optic fiber line 10.

The fiber optic wet-mate connector is a wet mateable connector system which provides connection between two fiber optic lines. Each first and second apparatus comprises a half part of the connector: a pin and a female part for interconnection. For example the fiber optic wet-mate connector can be of the type as described in U.S. Pat. No. 7,004,638 incorporated herewith by reference. Also for example, when the first and the second apparatus are cement plugs, perfect alignment of the pin and female parts for connection is ensured through the casing guiding. Also, for debris protection, the connector features a built in debris management system, which incorporates; a ramping profile on the receptacle unit (faces upwards) and large vent ports in the receptacle alignment sleeve. During mating, the piston effect of the plug nose entering the receptacle, ejects mud, sand and silt debris from the connector interface profiles, allowing an intimate fit between the mating connectors, prior to final engagement.

The wireless system is for example a radiofrequency emitter/receiver driving a light source and a photoreceptor at the end of both fibers. This type of radiofrequency emitter/receiver is described in U.S. patent application No. 60/882,358 from the same applicants and incorporated herewith by reference.

Figure 1B:
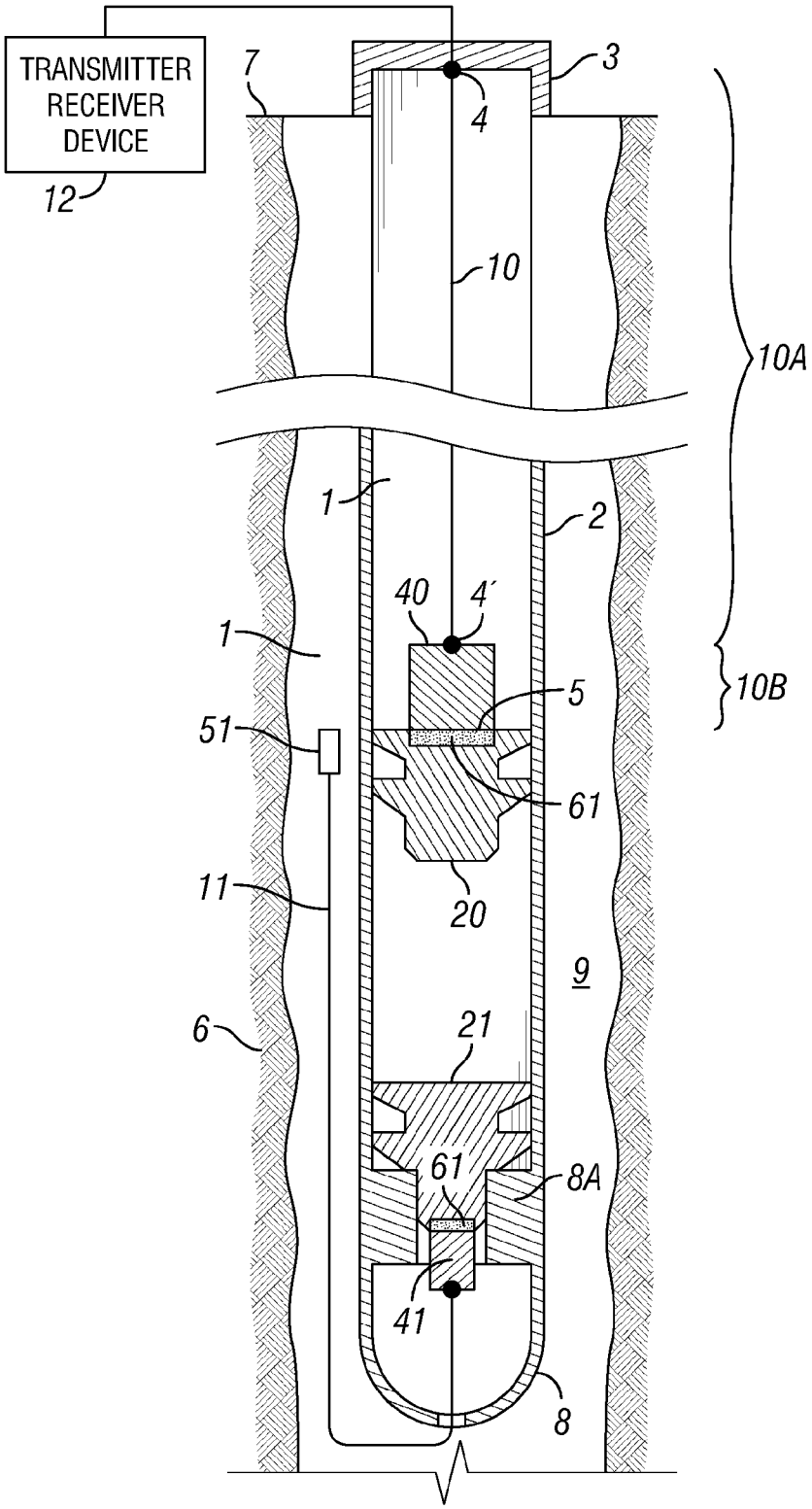
FIG. 1B shows a schematic diagram illustrating the system in a second embodiment according to the invention.

FIG. 1B is a view of the system in a second embodiment deployed in the cased wellbore 1 within the formation 6. The system according to the invention is made of a first apparatus embodied here as a plug 21, which comprises a first reel 41 of a first wound optic fiber line 11. The first reel 41 is located here at the bottom of the plug 21. Further, the first optic fiber line 11 is able to be unwound from the first reel 41. The first optic fiber 11 unwinds by passing through the guide and directly in the annulus 9 as shown on FIG. 1B. However by way of others embodiments, the first reel 41 can be located elsewhere, for example the plug can comprise a hole traversing entirely the plug, the first reel being located inside this one. Also by way of others embodiments, the first optic fiber 11 can be deployed inside the casing 2 and can also go through the guide shoe 8 into the annulus 9. The other characteristics of the system are the same as for the embodiment as disclosed on FIG. 1A.

Other preferable embodiments are disclosed herewith, applying to embodiments of FIG. 1A or FIG. 1B. Preferably, the second apparatus is of the type as disclosed in the European patent application number 06290801.7 from the same applicants. In this way, the light transmitter or receiver device is a light transmitter and receiver device of the type Optical Time Domain Reflectometer (OTDR). The OTDR is an instrument that can analyze the light loss in a fiber. The working principle consists to inject a short, intense laser pulse into the fiber and to measure the backscatter and reflection of light as a function of time. Preferably the OTDR is working at a wavelength of 1310 nanometers.

Preferably, the first 41 or second reel 40 of wound optic fiber line is made in such a way that the windings of the fiber ensure that the fiber can simply be unwound from the reel with a minimum tension applied on the fiber reel. The windings have to consider that unwinding can be operated at low or high speed, with low or high density for the surrounding fluid. In addition to the way the fiber is wound and the winding of this last one, an additional means to fix or to stick the windings of fiber can be used: special glue, a physical or chemical treatment of the fiber. Also, the fiber can be further treated so it is chemically resistant and able to withstand the huge abrasion of solid particles flowing at high speed within the wellbore for a certain period of time (typically 12 hours). For that purpose, fibers can be specially treated or can be packaged within a protective jacket. Additionally the reel can be associated with a housing or a dispensing cartridge which supports the winding of the fiber. The housing or the cartridge can directly be attached or fixed to the plug.

The sensor 51 is by way of example an optical sensor of the type Bragg grating sensor for measuring temperature. The Bragg grating sensors are realized by modulating the refraction index of an optical fiber line around its nominal value. They act as selective reflectors for the Bragg wavelength $\lambda_B$ defined by the following relationship: $\lambda_B=2.n.\Lambda$; where n is the refraction index of the fiber and $\Lambda$ the wavelength of the index modulation. $\Lambda$ being a linear function of temperature, measuring the Bragg wavelength $\lambda_B$ is a convenient way to measure the Bragg grating temperature typically at 1 degree Celsius. The key advantage of this technique is the fact that the measurement is remotely performed at a fiber end and does not involve costly and big downhole system. In this way, the sensor 51 is embodied within a part of the fiber line which was intentionally structurally modified. Also, the sensor 51 can be embodied within a part of the fiber thanks to its natural structure. For example end of the fiber line in direct contact with surrounding environments can act as a sensor. Geometry of the fiber is known, optical index may vary with the temperature, and at the interface representing fiber end (interface optic fiber/surrounding environment) backscatter or reflected light will inform on the temperature of the surrounding environment. This will also apply to other parts of the fiber line, and a distributed temperature along the fiber can be measured. Also, other parameters can be measured accordingly.

Other type of sensors can be used. Many other physical parameters are measurable using miniaturized sensor that are self supplied in power. The associated electronics are small and with low consummation: a sensor with limited volume and limited power supply allow a minimum bulk. For example, sensors can be of the type MEMS. The sensor can also be auto-sufficient in terms of power supply, as for example an optical sensor: there is no need of conventional and costly packaging including electronics, powers supply and analyzing devices. For instance, Bragg gratings sensors can also be used for pressure measurement and Bragg gratings sensors measuring both temperature and pressure can be realized.

In another embodiment, multiple optical sensors may be arranged in a network or array configuration with individual sensors multiplexed using time division multiplexing or frequency division multiplexing, those sensors can be deployed along the first fiber. Even, when Bragg grating sensors are used there is no need of using multiplexing; multiple Bragg grating sensors are arranged in network in series, each Bragg grating sensor having its wavelength and being interrogated by the light transmitter/receiver. Aim of deploying sensors along the fiber can provide a profile of measurement in the annulus. Also, the network of sensors may provide an increased spatial resolution of temperature, pressure, strain, or flow data in the wellbore.

Preferably, the first apparatus comprises an actuating system initiating the unwinding of the first optic fiber line (not shown). The actuating device can be in embodiment of FIG. 1A an unlocking device unlocking the first reel when a plug (for example the plug 20) is in contact with the landing collar 8A. In the same way, the actuating device can be in embodiment of FIG. 1B a rupture disk burst on the plug 21 (the plug has a hole and the first reel is located within) unlocking the first reel when the plug 21 is in contact with the landing collar 8A. Preferably, the first apparatus comprises also dispensing system helping the unwinding of the first optic fiber line (not shown). The dispensing device can be a wheel that moves in rotation when a fluid flows across: action of the rotation unwinds the first optic fiber line and action of fluid flow ensures displacement of the first optic fiber line along practically longitudinal lines of the annulus.

In other embodiments, the first apparatus can be made of different reels (not shown) of the type of the first reel, located uniformly around the landing collar for embodiment of FIG. 1A, in this way the reels will be able to unwound in the annulus at various location and if various sensors are used a three dimensional mapping of the annulus can be realized.

In another aspect the system described herewith is used in a method for cementing a well and monitoring said cementing process. FIGS. 2A to 2D discloses the steps of the method according to the invention. In a first step (FIG. 2A), when cement 70 is ready to be dispensed, a first plug 21 is released into the casing 2. The cement 70 is pumped behind the first plug, thereby moving the first plug downhole with spacer fluid 90. As the first plug 21 travels downhole, it seats against a landing collar 8A of the casing shoe 8. The landing collar comprises the first reel 41 and the exchange means 61 as described above and the casing shoe is embodied as the first apparatus. Hydraulic pressure from the cement above the first plug forces until it is sufficient to cause a membrane (a pressure disk burst) in the first plug to rupture. Thereafter in FIG. 2B, cement 70 flows through the first plug and the float valve and up into the annular space 9 between the formation 6 and the casing 2. In this second step the first reel 41 is allowed to be unwound, advantageously thanks to an actuating system (not shown). The first optic fiber line 11 is then carried by drag up into the annulus 9 with the cement 70. Normally, drag up forces are sufficient to allow good deployment of the first optic fiber line 11 into the annulus 8, however advantageously a dispensing system can be used to help the unwinding, for example a dispensing wheel put in rotation thanks to the flow of cement across (not shown), also an umbrella can be used at the end of the first optic fiber line (not shown).

Figure 2A:
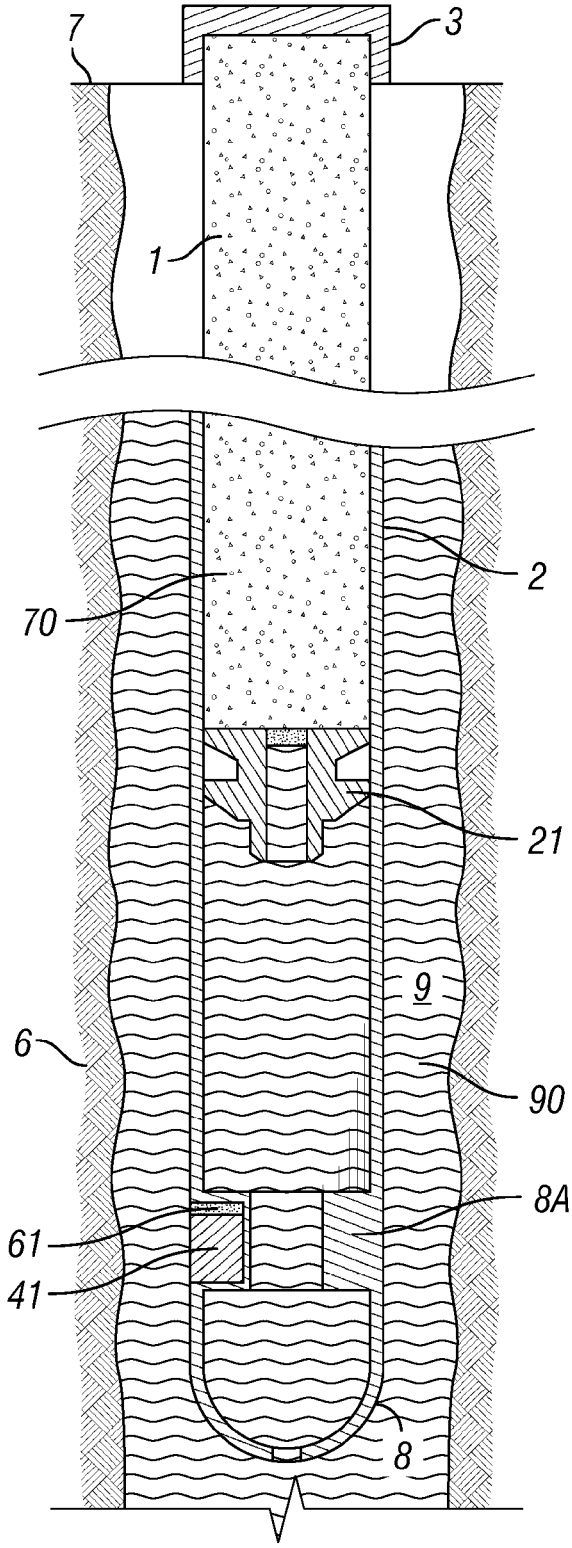
FIG. 2A to 2D show a schematic diagram illustrating the steps of the method according to the invention for the system in second embodiment.
Figure 2B:
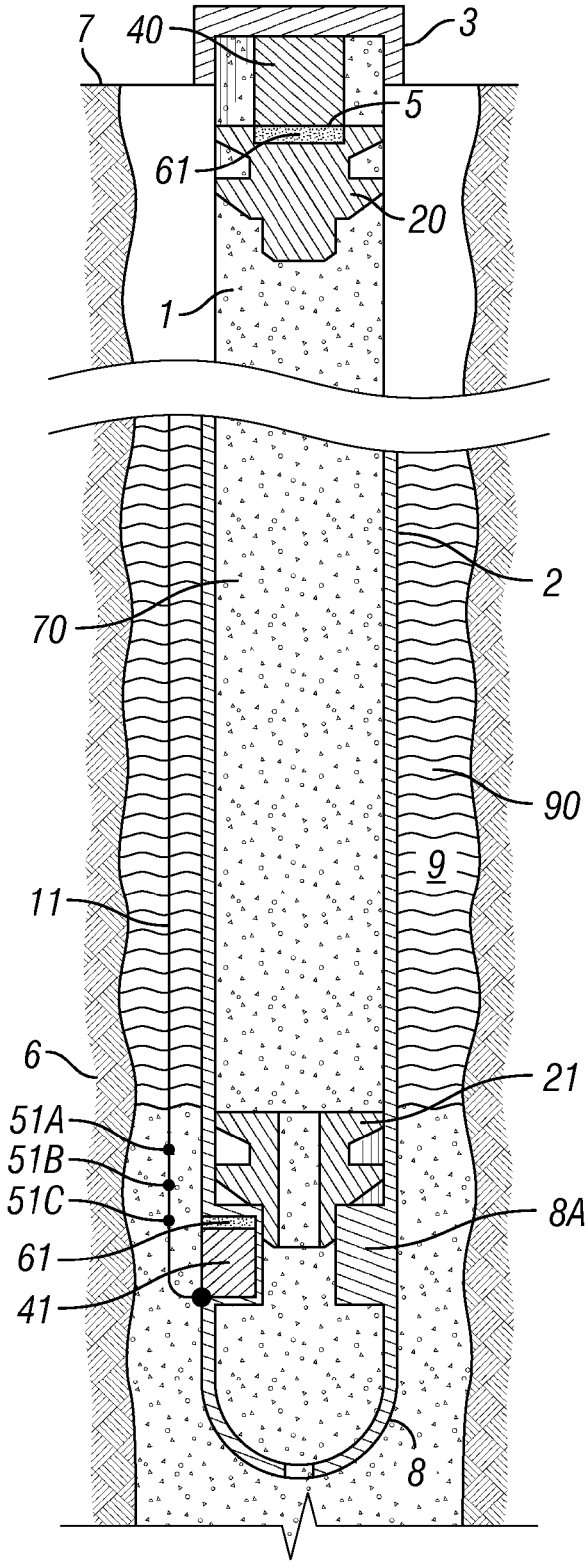
Figure 2C:
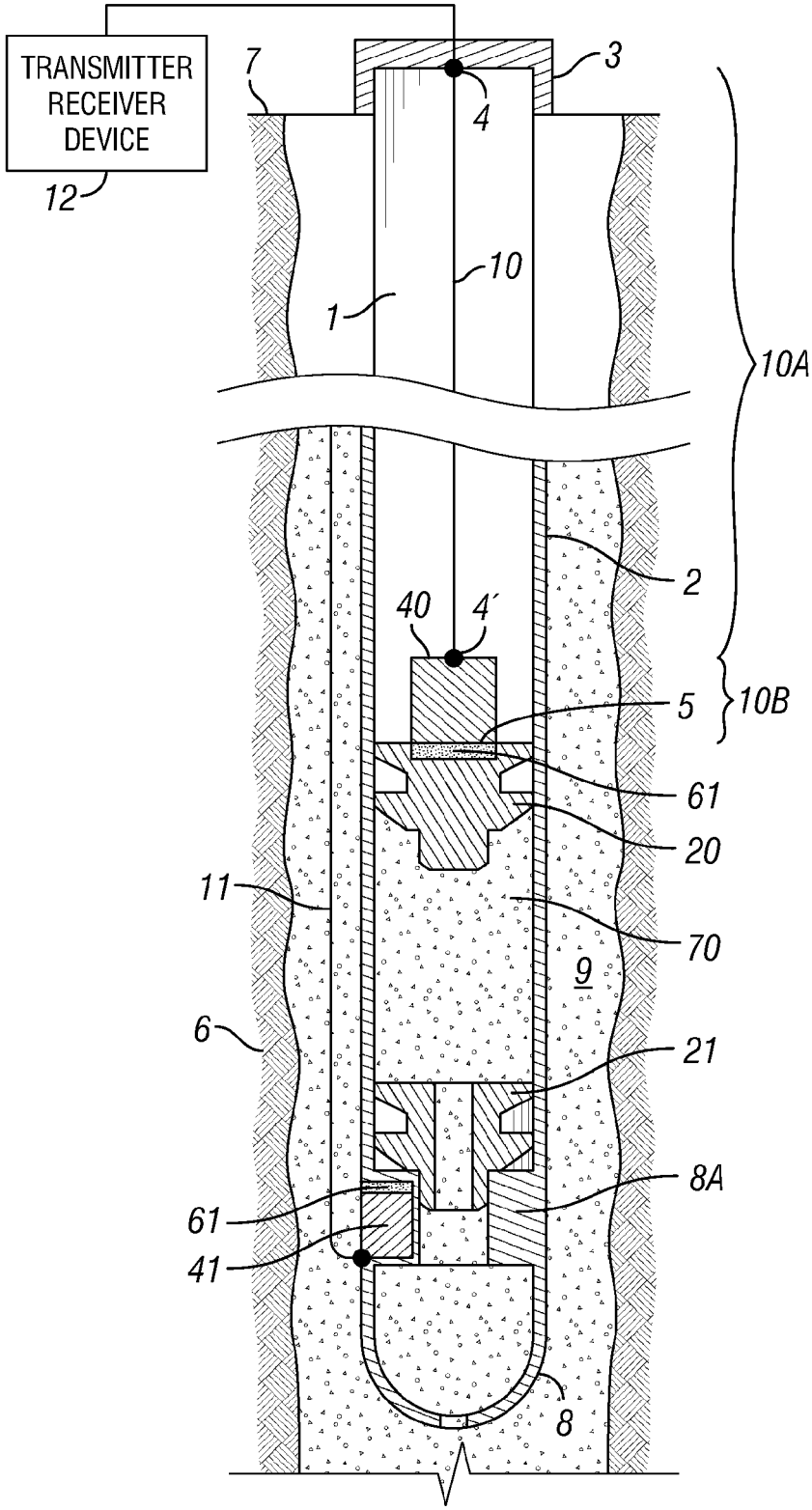

In FIG. 2C, the third step of the method is shown, wherein the second apparatus of the invention is deployed in the well. After a sufficient volume of cement has been placed into the wellbore, a second plug 20 is deployed in the casing 2. The second plug comprises a second reel 40 of second fiber optic line 10 and exchange means 61 as described above. As the second plug 20 travels downhole, the second fiber optic line 10 is deployed in the casing. At one end of the second fiber, the second fiber is attached or fixed to a first position 4, or a reference point. As it is understood, the second fiber is unwound from the second reel thanks only to the movement of the second plug at a second position 4', which correspond to a dynamic point. An upper part 10A of the second fiber corresponds to the unwound fiber (between the first position and the second position) and a lower part 10B of the second fiber corresponds to the wound fiber, still in the second reel. The dynamic point versus the reference point or the second position versus the first position informs on the location of the plug within the well or on the displacement rate of the plug within the well. The first position 4 is located inside a cementing head 3, which is a static point. From this first position the second fiber is linked to a light transmitter or receiver device 12. On the same time, the first fiber 11 is unwound from the first reel thanks to the continuing flow of cement 70. Advantageously, the first optic fiber line 11 comprises multiple sensors 51A, 51B, 51C . . . embodied within the first fiber. The sensors are of the type Bragg grating sensors. The sensors are dispatched along the second fiber in such a way that when the line is deployed within the annulus parameters can be controlled within said annulus at various depth and locations.

Figure 2D:
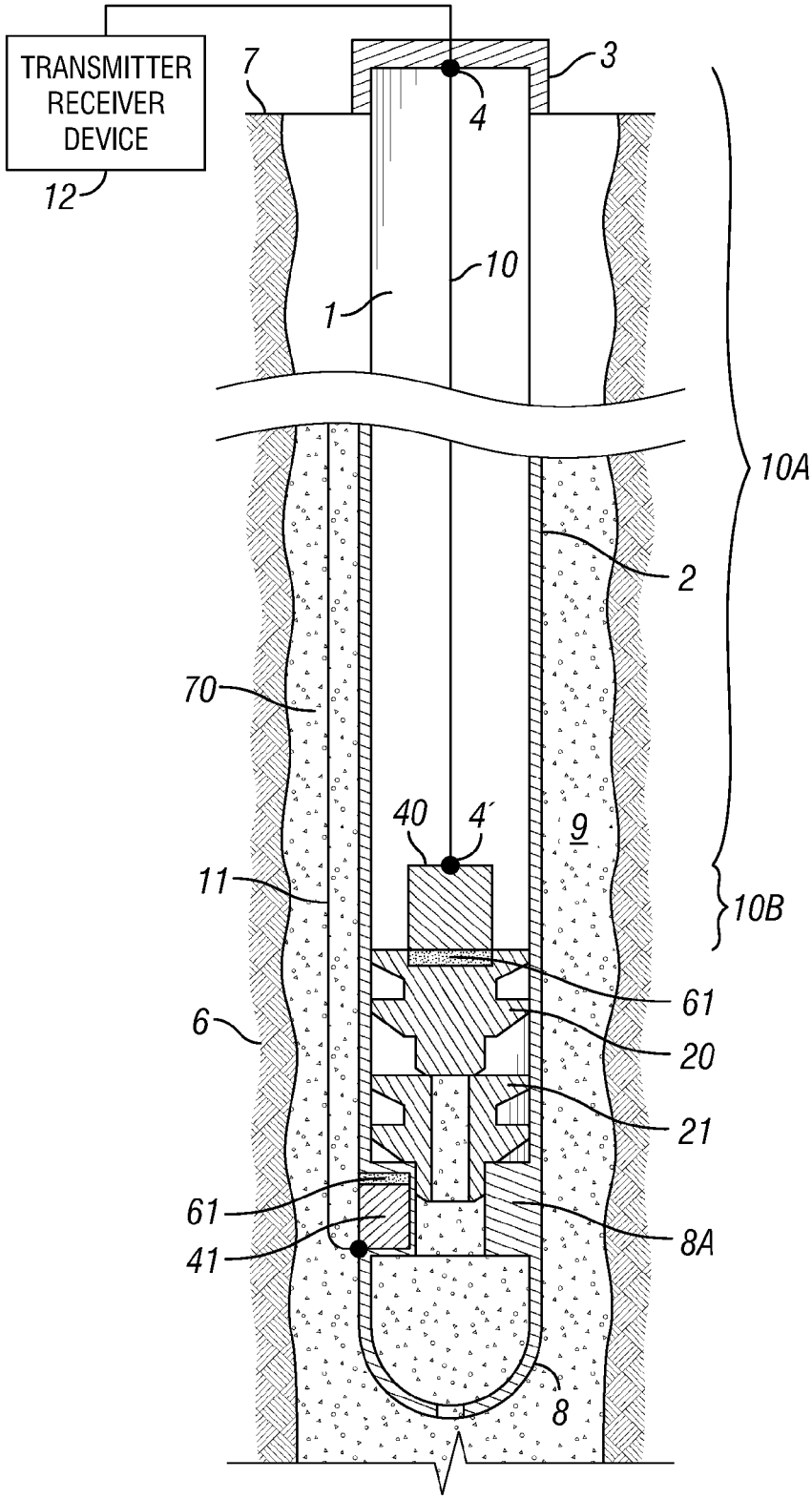

In FIG. 2D, the fourth step of the method is shown, wherein the second plug 20 seats against the first plug 21. The first optic fiber line 11 is then properly deployed in the annulus up to a predetermined depth, or even if required up to the surface 7. In this configuration first apparatus and second apparatus are in close vicinity to allow the exchange means 61 to work properly. In a first embodiment, the exchange means 61 will work when contact of both first and second apparatus will be done, interconnection of both parts of the exchange means 61 is required. In a second embodiment the exchange means 61 is wireless and will work when both parts of the exchange means 61 are in close vicinity. The exchange means can be self supplied in power, thanks to light energy coming from fiber. Advantageously electronics used in exchange means will be low or very low power consumption; in this case distance to transfer information wirelessly can be limited. However preferably, the exchange means 61 work when both parts are separated from less than 1 meter and more preferably less than 50 centimeters. Advantageously, the exchange means are RF emitter/receiver driving a light source and a photoreceptor. Thereafter, the cement 70 is allowed to cure.

Sensors 51A, 51B, 51C measure information on parameters in the well. For example as shown on FIG. 2D, sensors measure temperature in the annulus informing on set of the cement 70. Information is read from surface 7, thanks to light pulse: sent through second fiber 10, exchanged to first fiber 11 by the exchange means 61, sent to sensor and resent back by the same pathway to surface (sent through first fiber 11, exchanged to second fiber 10 by the exchange means 61 and finally sent through second fiber 10 to surface). By way of other embodiments, the first optic fiber line can reach the surface 7, or it can be attached to a Digital Telemetry System/Protocol (DTS/P) box so that we can have complete closed loop instrumentation in the cement 70. In other aspect, the second apparatus is of the type as disclosed in the European patent application number 06290801.7 from the same applicants, and method to determine depth, location speed of the second plug can be used.

Using the method above, we can confirm that both the first and second plugs have been deployed and have reached their correct operational positions. In addition, other information can be determined. Firstly, pressure and temperature in the pipe and hence time development of depth of plug are measured; thus confirming both launching and arrival of plugs as well as detailed of passage down the tubing (second plug only). Secondly, pressure and temperature in the annulus, and hence the time at which cement sets in the annular column can be determined as well. Waiting on cement time is one of the major contributors to non-productive time during the well construction process. Being able to accurately determine the time at which cement has set could significantly reduce this time. The increase in consistency when setting is accompanied by a temperature increase resulting from the exothermic reaction that occurs when the cement hydrates. The change in temperature (or perhaps the rate of change of temperature at a static hydrostatic pressure), could then be used to indicate that the operation has occurred, that the cement has set, and that operations can proceed. Thirdly, with continuous monitoring, we may also be able to detect via changes in distributed temperature or by attached acoustic sensors or by a direct density sensor whether there is an ingress of fluid from the reservoir in a microannulus. Indeed, we may be able to independently (form a cement bond log) corroborate whether the cement is a good bond or not.

If the first fiber to be deployed in the annulus is likely to reach surface it can also be deployed using an extra bottom plug that is pumped down the casing during mud circulation. This method would allow attaching the fiber to a DTS/P box so that temperature and pressure distribution in the annulus are available prior to starting the cement job itself.

The present invention has been described for plugs in the case of a cementing job, wherein location of the plug and/or information on the WOC are important to define. Other applications of the apparatus and the method according to the invention include attaching the reels of wound fiber to any type of object moved within the well, as for example perforating gun, retrievable packer or any type of tools moved within the well, as for example a drilling tool, a logging tool, a logging-while-drilling tool, a measuring-while-drilling tool, a testing tool; any type of tool hanged by a drill pipe, a wireline cable, a coiled tubing. Other applications of the apparatus and the method according to the invention include fixing the first position on any of static or dynamic point, for example in subsea or downhole operations.

The invention claimed is:

1. A system for measuring a parameter within a well, made of:

a first apparatus, embodied within a first plug, comprising a first reel of first wound optic fiber line, wherein the first reel is in a collar launching, a first part of the first optic fiber line is wound and a second part of the first optic fiber line is unwound in an annulus;

at least a first sensor located on said second part wherein said first sensor is able to measure the parameter of said annulus, wherein information on said parameter can be transmitted through the first optic fiber;

a second apparatus, embodied within a second plug, comprising a second reel of second wound optic fiber line, inside the second plug, that is able to be unwound from the second reel, an extremity of the second optic fiber being fixed to a reference point;

a light transmitter or receiver device linked to the reference point and able to generate or detect a light pulse through the second optic fiber line; and an exchange device to transfer said light pulse between the first and the second optic fiber line.

2. The system of claim 1, further comprising a plurality sensors distributed on the first optic fiber line.

3. The system of claim 2 wherein the first sensor or the plurality of sensors are Bragg grating sensors.

4. The system of claim 1, wherein the second apparatus further comprises at least a second sensor.

5. The system of claim 4, wherein the second sensor is located on the second optic fiber line.

6. The system of claim 1, wherein the second apparatus further comprises a plurality of sensors distributed on the second optic fiber line.

7. The system of claim 6 wherein the second sensor or the plurality of sensors are Bragg grating sensors.

8. The system of claim 1, wherein the reference point is located at the surface of the well.

9. The system of claim 1, wherein the parameter is selected from the group consisting of temperature, pressure, pH, density, resistivity, conductivity, salinity, carbon dioxide concentration, and asphaltene concentration.

10. The system of claim 1, wherein the exchange device is a wireless telemetry system.

11. The system of claim 1, wherein the first apparatus further comprises an actuating system initiating the unwinding of the first optic fiber line.

12. The system of claim 1, wherein the first apparatus further comprises a dispensing system helping the unwinding of the first optic fiber line.

13. The system of claim 1, wherein the system comprises a light transmitter and receiver device able to generate and detect the light pulse.

14. The system of claim 10, wherein the exchange device is an RF emitter/receiver device.

15. A method for measuring a parameter within a well, comprising the step of:

(i) unwinding a first reel of first wound optic fiber line in a collar launching positioned on a first apparatus that is embodied within a first plug;

(ii) unwinding from a reference point a second reel of second wound optic fiber line positioned on a second apparatus, wherein the second reel and the second apparatus are embodied within a second plug;

(iii) transmitting or receiving from the reference point a light pulse through the second optic fiber line;

(iv) exchanging said light pulse between first and second optic fiber lines; and (v) sensing with said light pulse the parameter and transmitting it on the first optic fiber line.

16. The method of claim 15, wherein the exchanging step is made also by bringing closer the first and second apparatus.

17. The method of claim 16, wherein the exchanging step is made by interconnecting the first and second optic fiber lines.

18. The method of claim 16, wherein the exchanging step is made by transforming the light pulse from one optic fiber line into an electromagnetic or acoustic signal, transferring said signal within the well and re-transforming said signal into the light pulse in the second optic fiber line.

19. The method of claim 15, wherein the sensing step is made by sensing with said light pulse the parameter on said first optic fiber line.

20. The method of claim 19, wherein further steps of sensing are made with a plurality of parameters and light pulses.

21. The method of claim 15, wherein the reference point is at the surface.

22. A method for communicating a parameter within a well, comprising the step of:

(i) unwinding a first reel of first wound optic fiber line in a collar launching positioned on a first apparatus that is embodied within a first plug;

(ii) unwinding from a reference point a second reel of second wound optic fiber line positioned on a second apparatus, wherein the second reel and the second apparatus are embodied within a second plug;

(iii) transmitting or receiving from the reference point a light pulse through the second optic fiber line;

(iv) exchanging said light pulse between first and second optic fiber lines; and (v) transmitting the light pulse through the first optic fiber line; and (vi) thereby communicating said parameter between the first and second optic fiber lines.

23. The method of claim 22, wherein the exchanging step is made also be bringing closer the first and the second apparatus.

24. The method of claim 23, wherein the exchanging step is made by interconnecting the first and second optic fiber lines.

25. The method of claim 23, wherein the exchanging step is made by transforming the light pulse from one optic fiber into an electromagnetic or acoustic signal, transferring said signal within the well and re-transforming said signal into the light pulse in the second optic fiber line.

26. The method of claim 22, wherein the reference point is at the surface.

* * * * *